US007775901B2

(12) United States Patent
Cooper et al.

(10) Patent No.: US 7,775,901 B2
(45) Date of Patent: Aug. 17, 2010

(54) GOLFING EQUIPMENT

(76) Inventors: Teddy Barney Cooper, Bock Hill House, Winkfield Row, Bracknell, Berkshire, RG42 6NA (GB); Teddy Walter Joshua Barney Cooper, Bock Hill House, Winkfield Row, Bracknell, Berkshire, RG42 6NA (GB); James Richard Barney Cooper, Bock Hill House, Winkfield Row, Bracknell, Berkshire, RG42 6NA (GB)

( * ) Notice: Subject to any disclaimer, the term of this patent is extended or adjusted under 35 U.S.C. 154(b) by 0 days.

(21) Appl. No.: 11/732,994

(22) Filed: Apr. 5, 2007

(65) Prior Publication Data

US 2007/0238543 A1 Oct. 11, 2007

(51) Int. Cl.
*A63B 53/00* (2006.01)

(52) U.S. Cl. ..... 473/288; 206/315.6

(58) Field of Classification Search ..... 473/282, 473/287–288, 298–299, 306–307, 290–291; D21/796; D6/552; 206/315.3, 315.2, 315.6; 211/70.2, 68

See application file for complete search history.

(56) References Cited

U.S. PATENT DOCUMENTS 682,960 A * 9/1901 Slazenger ..... 473/306
936,698 A * 10/1909 Breakspear ..... 206/315.6
1,443,230 A * 1/1923 Luckett ..... 248/530
1,543,636 A * 6/1925 Williamson ..... 473/306
3,209,918 A * 10/1965 Farrell ..... 211/68
3,530,919 A * 9/1970 May ..... 206/315.4
3,829,092 A 8/1974 Arkin
3,848,737 A 11/1974 Kerron
4,182,391 A * 1/1980 Kjose ..... 224/581
4,253,666 A 3/1981 Murphy
4,280,700 A * 7/1981 Plagenhoef ..... 473/289
4,340,227 A * 7/1982 Dopkowski ..... 473/288
4,497,404 A * 2/1985 Lowrance ..... 206/315.2
4,664,382 A 5/1987 Palmer
4,852,782 A * 8/1989 Wu et al. ..... 224/661
D312,170 S * 11/1990 Carman ..... D3/255
4,982,883 A * 1/1991 Ullal et al. ..... 224/651
5,361,958 A * 11/1994 Fiegel et al. ..... 224/274
6,039,659 A 3/2000 Hamm
6,233,739 B1 5/2001 Spence
6,371,865 B1 4/2002 Magliulo
6,371,866 B1 4/2002 Rivera
D535,347 S * 1/2007 Cialdella et al. ..... D21/796
7,320,401 B1 * 1/2008 Chandler ..... 206/315.2
7,350,683 B2 * 4/2008 Meyer ..... 224/628

* cited by examiner

*Primary Examiner*—Stephen L. Blau

(57) ABSTRACT

A lightweight golfing kit particularly suited to use on pitch-and-putt courses comprises one or more golfing shafts, two or more clubheads demountably attachable thereto, and a carrier assembly including a holster open at both ends for supporting the shaft or shafts. The carrier may include a case for the clubheads supporting the holster in an upright position, and loops for supporting the assembly from a golfer's shoulders. Optionally a golfing shaft may be adjustable in length. The assembly may also include a detachable belt.

1 Claim, 2 Drawing Sheets

GOLFING EQUIPMENT

This invention relates to golfing equipment.

Golf is a game that provides interest, stimulation and exercise for men and women of all ages. It may be played professionally, or be an amateur pursuit. A full golf-course comprises 18 holes, of total length perhaps 6 or 7,000 meters: but golf may also be played on 9-hole courses, or 'pitch-and-putt' courses.

A full set of equipment for a golfer comprises 14 clubs—typically, a set of nine irons, a putter, and four wooden clubs. The full set is unwieldy. Lugging a complete set of clubs, with a bag and other adjuncts, for example balls, around a course of 6 or 7,000 meters is a challenge to many participants: young people and the elderly, for example. Moreover, a full set of clubs is expensive, which may deter people from taking up the sport.

An object of the present invention is to provide golfing equipment which is lighter, more compact, more convenient and cheaper, thereby enabling more people to enjoy the sport.

According to the present invention we provide a set of lightweight golfing equipment that comprises one or more golfing shafts, two or more clubheads demountably attachable to at least one such shaft, and means for a golfer to carry the shafts and clubheads comprising a carrier assembly including a holster open at both ends for supporting the shaft or shafts. Preferably the assembly is adapted to be carried on a golfer's back with the holster disposed upright.

Embodiments of the invention may comprise a set of clubheads in association with a single shaft, or with more than one shaft, for example three shafts. A single shaft offers the greatest simplicity and weight saving, and may be most suitable for less serious applications (for example on pitch-and-putt or par-3 courses). A set of clubheads for such use may have no more than three members, for example a 2-iron, a 9-iron and a putter. For use on longer courses, it may generally be preferred to have two or three shafts, for example a driving shaft for woods, a shaft for irons and a putting shaft, which may be of different lengths and flexibility: with correspondingly larger sets of clubheads. In an alternative arrangement, three shafts are provided: one for woods, one for irons, for example for irons numbered 2 to 9; and a third for sand wedge, pitching wedge and putter.

For some applications, it is preferred that the equipment comprises a single shaft. However, the working length of such a shaft will not be equally suited to all clubheads in the set. One embodiment of the invention comprises a shaft of working length appropriate to the clubhead or heads requiring the minimum length of shaft (which may be, for example, the putter). Other clubheads in the set have short extensions of varying length, so as to produce, when mounted on the shaft, a club of working length appropriate to each clubhead.

Where the equipment comprises more than one shaft, the set of clubheads may be divided into disjoint subsets for use with each shaft. Such subsets may be distinguished from each other by appearance (colour or pattern, for example); or by mounting, so that clubheads of each subset fit only one of the shafts; or by both appearance and mounting.

According to another embodiment of our invention, the or a shaft according to the invention is adjustable so as to vary in working length between a maximum and a minimum. The working length may be adjustable in various ways. For example, in a conventional set of golf clubs, irons numbered from 2 to 9 decrease progressively in length as the club number increases. The grip of a shaft according to our invention may be adjustable in several fixed positions, giving several different working lengths of shaft appropriate to different clubheads. The fixed positions may correspond to lengths suitable for each iron clubhead—and may conveniently be correspondingly numbered, e.g., from 2 to 9. If desired, the working length of the shaft may be separately varied continuously over a short range—up to 5 or 10 cm, say—to suit the stature and preferences of the individual player. Such adjustment (unlike adjustment between the fixed positions) will however not normally be made between shots in the course of a round.

The nature of the mounting between the clubhead and the shaft is important for carrying out our invention in the most effective manner. To work well, the mounting must be firm and robust, so that the combination of clubhead and shaft handles well as a unit, but at the same time the mounting must be quick and easy to connect and disassemble.

One suitable form of mounting comprises a cylindrical post on the clubhead mating with a cylindrical sleeve in the shaft. A thread holds the sleeve and post together. The positioning of the clubhead is assured by a stop at the end of the sleeve to abut a stop at the base of the post. Alternatively or additionally the clubhead may be positioned by a spring-mounted finger on the post which snaps into a slot on the sleeve of the shaft when the two are aligned. This arrangement is demountable by depressing the finger to compress the spring so that the clubhead can be unscrewed.

In an alternative arrangement the clubhead carries a post which is triangular in section, to mate with a sleeve of triangular section formed in the end of the shaft. The triangular post cannot rotate in the shaft sleeve, and so cannot itself carry a thread. The clubhead may be held onto the shaft by a spring-mounted finger (or, better, an opposed pair of spring-mounted fingers) co-operating with a slot (or slots) in the shaft sleeve. Alternatively or additionally, a column at the base of the triangular post may be threaded, so as to be held on the shaft by a freely rotating crown screw at the base of the shaft sleeve. As well as posts with triangular cross-sections, posts and co-operating sleeves of other cross-sections, e.g., square or hexagonal, may be used. Round or triangular posts, obviously, will not fit into square sleeves: and by this means it is possible to ensure (if desired) that specific clubheads are used only with specific shafts.

In alternative constructions similar mounting means may be used, but carrying the post on the shaft, with the sleeve on or extending into the clubhead.

The invention will be further described with particular reference to the drawings, in which.

Figure 1:
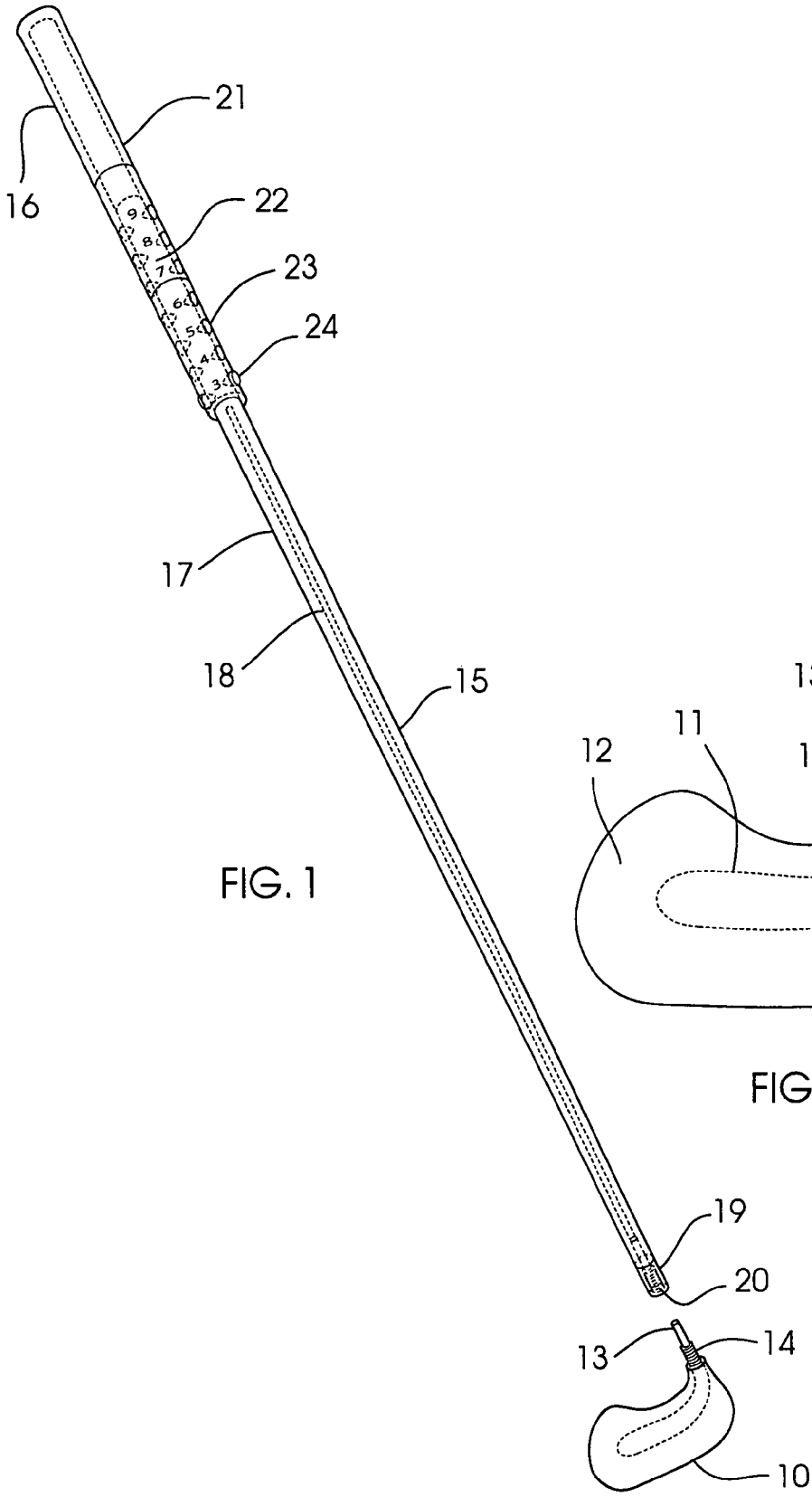
FIG. 1 is a perspective view of a disassembled shaft and clubhead useful in our invention.
Figure 2:
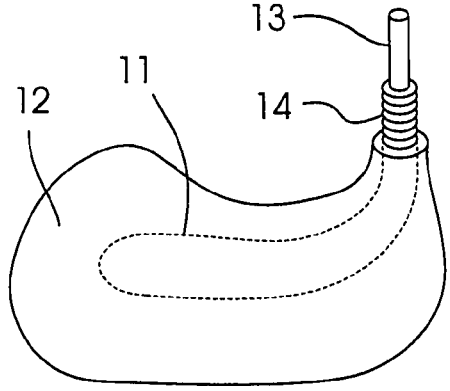
FIG. 2 is a schematic detail view of a clubhead useful in the invention.

In FIGS. 1 and 2, a clubhead 10 comprises a steel inset 11 around which is moulded a thermosetting resin 12 in the form of a wooden club (driver). The inset 11 carries on the end protruding from the clubhead 10 a cylindrical post 13, at the base of which is provided a male threaded portion 14. The shaft 15 comprises a grip 16 mounted on a tubular body 17. The body 17 carries an interior steel rod 18 running along its length, and formed at its lower end with a cylindrical sleeve 19 terminating in a female thread 20. In operation, the post 13 of clubhead 10 is inserted into the sleeve 19, fitting snugly, and held securely therein by engaging the female thread 20 with the male thread 14. After the player has driven off from the tee, the driver clubhead 10 may be disengaged from the shaft 15 by unscrewing, and a different clubhead (e.g., a fairway wood or an iron) substituted.

The shaft 15 is adjustable in length. The grip 16 comprises a rubber moulding 21 mounted on a cylindrical sleeve 22.

This carries a set of seven pairs of opposed ports 23 corresponding to seven working lengths of the shaft 15. The pairs of ports 23 are numbered consecutively with the digits 3 to 9, the pair nearest the clubhead being numbered 3. The shaft 15 carries opposed spring-loaded fingers 24 which can be set to engage with any pair of opposed ports 23 to lock the sleeve 22 into position. By this means the working length of the shaft 15 may be adjusted to suit the clubhead selected for mounting on it.

The equipment of our invention is further characterised by the assembly used to transport it. This comprises a holster for the shaft or shafts, open at both ends, and adapted to hang upright between the shoulders of the player. The assembly may also comprise a carrying-case for clubheads, and may alternatively or additionally be linked to a waist-mountable belt having compartments for clubheads or golfballs. The carrying-case or belt may also be adapted to include other golf equipment, for example balls, tees, gloves, towels, scorecards and scoring-pencils.

Figure 4:
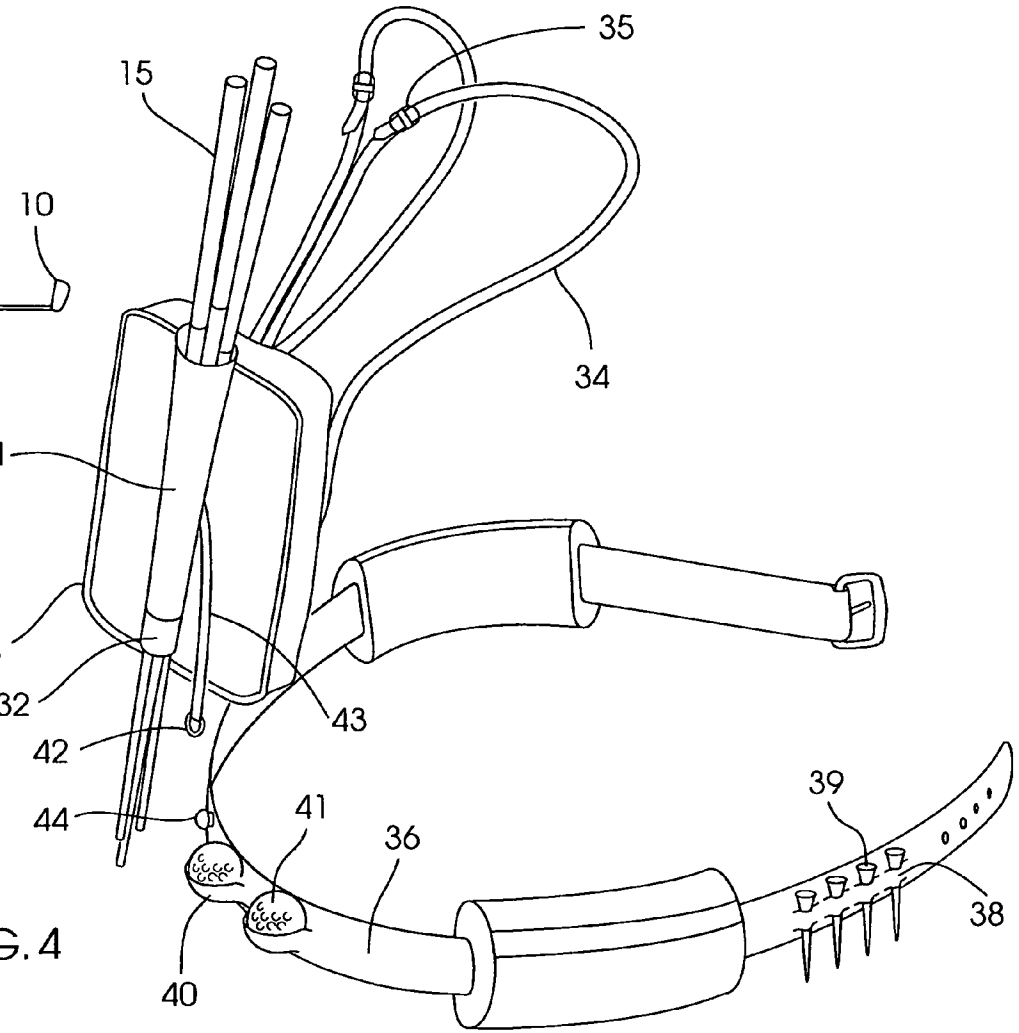
FIG. 4 shows a player wearing the carrier of FIG. 3.
Figure 3:
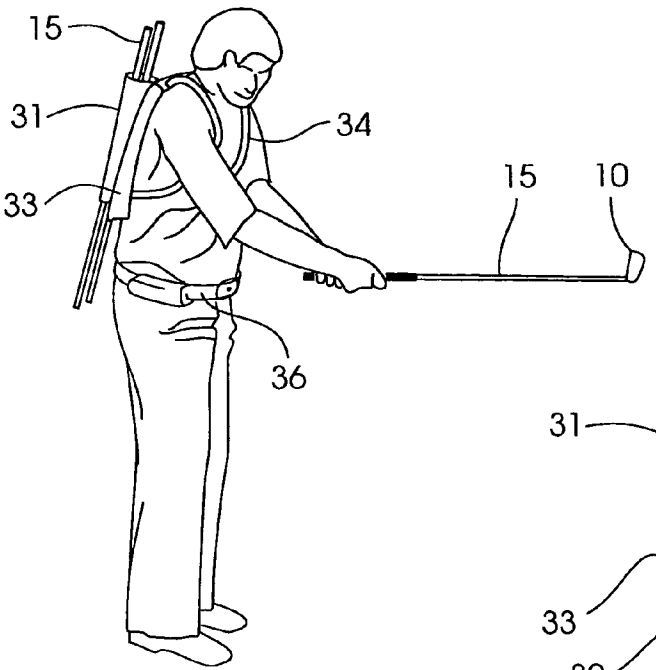
FIG. 3 shows a shoulder-mounted carrier and linked belt for use with the invention.

FIGS. 3 and 4 show one form of carrier used in the invention, a combined shoulder-carrier and belt. The shoulder-carrier comprises a holster 31 open at both ends. The bottom end 32 is constricted with elastic so as to receive and grip up to three shafts 15. The holster 31 is mounted on a carrying-case 33 which opens (e.g., by unzipping) to receive fourteen clubheads 10, each in its own individual pouch. The holster 31 and case 33 are supported by shoulder straps 34, adjustable to the wearer's preference by buckles 35. The holster 31 and case 33 may also be linked to a belt 36, adjustable by a buckle 37, and fitted with holders 38 for tees 39 and slots 40 for carrying golfballs 41. An eye 42 on a strap 43 serves to detachably link the shoulder-carrier to a button 44 on the belt 36.

Holsters may be rigid or flexible, made for example of plastics or stout cloth, optionally mounted on a metal frame. An alternative form of holster 31 designed for use with more than one shaft has internal means for separating two or more shafts from one another. These may comprise clips, loops, or tubular housings of cloth or plastics material for receiving and holding each shaft separately. An advantage of an open holster is that it can be notably shorter than the full length of a shaft and so is lighter and less awkward to handle.

We claim:

1. A lightweight set of golfing equipment for a golfer comprising:

at least two golf shafts;

at least two club heads each demountably attachable to at least one golf shaft;

a carrier assembly mountable on the golfer for separately supporting said at least two golf shafts and said at least two club heads, said carrier assembly being suitable for wearing by the golfer while playing shots and throughout the golf round; and wherein said carrier assembly comprises a holster for supporting said at least two golf shafts which is open at both ends allowing said golf shafts to project through said holster.

* * * * *